US005399300A

United States Patent [19]

Notar

[11] Patent Number: 5,399,300

[45] Date of Patent: Mar. 21, 1995

[54] STORAGE TANK FOR A CARBONATOR INCLUDING COOLING SYSTEM CONTROL MEANS THEREFOR

[75] Inventor: Robert Notar, Knittlingen, Germany

[73] Assignees: The Coca-Cola Company, Del.; Bosch-Siemens Hausgerate GmbH, Germany

[21] Appl. No.: 233,967

[22] Filed: Apr. 28, 1994

[30] Foreign Application Priority Data

Aug. 28, 1992 [DE] Germany ..... 42 28 776.6

[51] Int. Cl.[6] ..... B01F 3/04

[52] U.S. Cl. ..... 261/130; 261/131; 261/140.1; 261/DIG. 7; 62/59; 62/139

[58] Field of Search ..... 261/DIG. 7, 140.1, 130, 261/131; 62/59, 139

[56] References Cited

U.S. PATENT DOCUMENTS

| | | | |
|---|---|---|---|
| 2,622,923 | 12/1952 | Cobb | 62/59 |
| 4,011,733 | 3/1977 | Kuckens et al. | 62/59 |
| 4,148,334 | 4/1979 | Richards | 261/140.1 |
| 4,476,690 | 10/1984 | Iannelli | 62/59 |
| 4,480,036 | 5/1984 | Iannelli . | |
| 4,497,179 | 2/1985 | Iwans | 62/139 |
| 4,843,830 | 7/1989 | Haul | 62/139 |
| 4,907,417 | 3/1990 | Forsythe . | |
| 5,163,298 | 11/1992 | Hassell et al. | 62/139 |

FOREIGN PATENT DOCUMENTS

| | | |
|---|---|---|
| 191436 | 8/1986 | European Pat. Off. . |
| 315439 | 10/1989 | European Pat. Off. . |
| 471342 | 2/1992 | European Pat. Off. . |
| 471343 | 2/1992 | European Pat. Off. . |

OTHER PUBLICATIONS

International Search Report and U.S. counterpart Patent 5,184,942 to EPO reference 471,343.

*Primary Examiner*—Tim Miles

[57] ABSTRACT

A carbonator having a cooling system which is controlled by a controller responsive to input signals generated by an ambient temperature sensor, an ice thickness sensor and a water level sensor. After an initial ice build up following first turn-on of the system and depending on the ambient temperature sensed by the temperature sensor, the cooling system will turn on for a predetermined ON period followed by a predetermined OFF period. These ON and OFF periods are variable as a function of ambient temperature as sensed by the temperature sensor and will recycle in absence of any carbonated water removed. If, however, water removal takes place, the OFF period is interrupted and system turn-on will occur the next time a signal from the ice sensor is received and the ON and OFF cycle as determined by the system controller will resume unless it is again interrupted by another water removal signal from the water level sensor.

3 Claims, 1 Drawing Sheet

STORAGE TANK FOR A CARBONATOR INCLUDING COOLING SYSTEM CONTROL MEANS THEREFOR

This is a continuation of International Application PCT/EP93/02279, with an international filing date of Aug. 25, 1993.

BACKGROUND OF THE INVENTION

This invention relates to apparatus for mixing water with $CO_2$ gas to produce carbonated water in a storage tank and operates to cool its contents and to form an ice bank adjacent the cooling pipes of a cooling circuit in the wall area of the storage tank, whose interior also includes the placement of a circulating pump, whereby $CO_2$ gas from the head area of the storage tank is mixed by rotation and/or circulation with the water inside the storage tank. Both fresh water and $CO_2$ gas are fed into the head area of the storage tank while carbonated water is removed from the base or bottom of the tank.

Apparatus which mixes water with $CO_2$ gas to produce carbonated water is well known and is used, for example, in post-mix beverage dispensing machines so that carbonated beverages can be prepared and dispensed on demand by mixing carbonated water with a suitable drink concentrate. The carbonated water mixed with the drink concentrate is produced directly in the storage tank by mixing water and $CO_2$ gas which is fed thereto and thereafter cooled for better carbonation, this being a requirement for a cool refreshing drink which is prepared for consumption as the need arises. The storage tank, commonly referred to as a carbonator, is fed fresh water of drinking quality either from the line of a water supply system or a pressurized storage tank. The fresh water, moreover, can be fed from the water supply system under pressure and can be enhanced, when desired, by the use of a pressure pump. Further, $CO_2$ gas is fed to the carbonator from a $CO_2$ gas storage tank by a pressure-reducing regulating valve so that a pressure of, for example, about 4 bars is built up in the carbonator.

In order to ensure sufficient carbonation of the fresh water, the carbonation process can be accomplished by or assisted by the use of a $CO_2$ circulating pump located in the carbonator. This type of pump draws $CO_2$ gas from the upper or head-space region of the carbonator filled with $CO_2$ gas and blends it with circulating water which is set in circular motion, such as by spinning.

As already noted, cooling of the carbonator is used, not only to improve the carbonation, but also as a requirement so that the finally prepared and dispensed drink exhibits a desired low and basically constant temperature. The cooling of the carbonator is achieved by a cooling system, which is adapted to form an ice bank of generally uniform thickness along the inner side walls of the carbonator as a result of the circulating water. Consequently, a cooling capacitor is produced, thus enhancing its "refrigerating capacity", thereby removing the need for a relatively powerful cooling system which would be necessary in a once-through cooling system.

In the dispensing of a freshly prepared carbonated drink, a shutoff valve is typically opened in a line connected to the bottom of the carbonator, whereupon cooled carbonated water is fed therefrom to a concentrate mixing station. As a result of forming the ice bank in the area of the cooling coils, the carbonated water is cooled to near the freezing point.

Arrangements having a corresponding design as described above are well known, a typical example being shown and described in U.S. Pat. No. 5,184,942, Deininger et al, Feb. 9, 1993.

Apparatus of the type described above is designed for normal use and typical operating conditions. These conditions include not only its inherent operating characteristics, but also its intended operating environment. Thus, one assumes that household equipment is used in settings where standard temperature conditions are encountered. For cooling equipment, including not only refrigerators and freezers, but also cooling apparatus for post-mix carbonated beverage dispensers, external temperature conditions, however, can be of great importance due to the fact that performance efficiency of the cooling system declines as a function of the increase of the temperature difference between the area to be cooled and the immediate surroundings. The converse is also true.

Accordingly, cooling systems are normally designed so that even with relatively high ambient temperatures, sufficient cooling can be provided for its intended use. However, since such cooling systems are also used at relatively low ambient temperatures, their output capacity is usually compensated for by factors which results in over design of the equipment. This fact per se appears to be rather harmless. However, in the case of carbonator storage tanks for preparing and then storing carbonating water for subsequent use in a post-mix dispenser, cooling coils of a cooling circuit used to cool the water are located in the wall area of the tank. In such apparatus, it has been observed that any significant temperature reduction relative to normal room temperatures can produce disadvantageous results. These drawbacks can be overcome, partially at least, not only by the inertia of the refrigeration system, but also by the reduced heat conductivity of the ice in the ice bank typically formed inside the tank adjacent the cooling coils.

Although the thickness of the ice bank is monitored by means of an ice sensor which controls the refrigeration cycle, the ice bank tends to become thicker when the outside or ambient temperature drops. This has been found to lead to undesirable consequences such as malfunctions inside the carbonating water storage tank.

SUMMARY OF THE INVENTION

Accordingly, it is the principal object of the present invention to provide an improvement in carbonator apparatus which is capable of preventing such undesired cooling malfunctions for a relatively small cost.

Apparatus which meets these requirements includes a room temperature sensor which detects the ambient temperature surrounding the storage tank. This sensor is connected to a cooling system controller which operates in response to the output of the room temperature sensor such that after each ON period of the cooling system, an OFF period is commanded for a predetermined minimum period even though, during this period, a subsequent turn-on command is signaled by an ice bank sensor.

Apparatus operating in accordance with the foregoing features is based on at least two considerations, one of which is that the thickness of the ice bank formed on the wall of the storage tank by the evaporator coils of the cooling system has a thermally insulating effect, and at low ambient temperature, the temperature drop from the wall of the storage tank to the liquid inside area is at a maximum. Thus, if the cooling circuit is turned off by a signal from the ice sensor, a gradual temperature creep takes place, causing the ice bank to build up to an undesired thickness on the inside wall of the storage tank. The second consideration is that at low ambient temperatures only a relatively small amount of heat is transferred to the storage tank. In any event, it is greatly reduced so that the cooling capacity stored in the storage tank by the ice shell and the other contents is very stable. This is particularly true where the storage tank is surrounded by reliable heat insulation.

Accordingly, these conditions are accounted for in a simple way so that trouble-free operation is achieved in that at low ambient temperatures, the frequency of the on-phase of the cooling system is suitably reduced. This is particularly true during prolonged idle periods, where no cooled carbonated water is removed from the storage tank.

When carbonated water is removed from the storage tank, new operating conditions are imposed as a function of ambient temperature such that each on-cycle of the cooling circuit lasts a preset time independently of the signalling of the ice sensor as a function of the room temperature. The lower the ambient temperature, the shorter the on-cycle, with length thereof being determined empirically.

BRIEF DESCRIPTION OF THE DRAWINGS

The details of the invention as set forth below will be more readily understood when considered together with the following drawings, wherein.

DETAILED DESCRIPTION OF THE INVENTION

Figure 1:
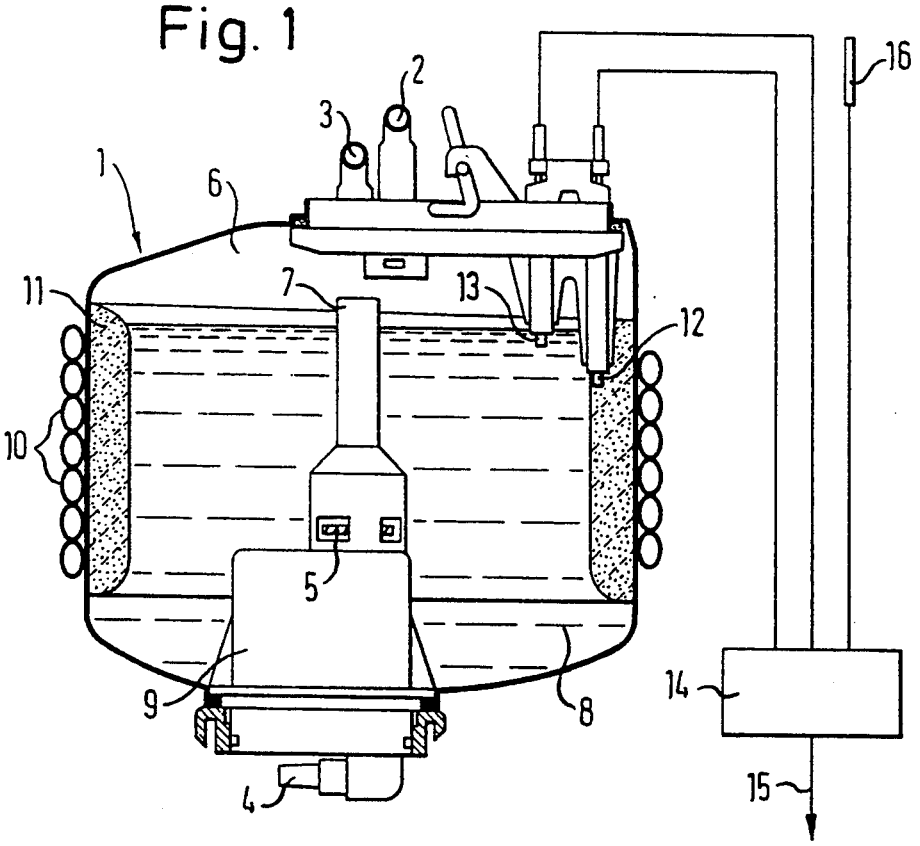
FIG. 1 is a schematic illustration of a carbonator storage tank including a circulating pump for preparing and holding carbonated water.

Referring now to the drawings, a storage tank 1, as depicted in FIG. 1, comprises a carbonator utilized in connection with apparatus for preparing post-mix beverages where a suitable drink concentrate is added to carbonated water or simply to fresh water when carbonation is not desired.

When replenishment is required, fresh water is fed into the storage tank 1 by a feed pipe 2 while $CO_2$ gas is supplied by a feed pipe 3. To prepare a post-mix carbonated beverage outside of the storage tank 1, a measured amount of cooled carbonated water is removed from the tank by means of an output line 4.

Carbonation takes place and is assisted by a circulating pump 5 which draws $CO_2$ gas present in the headspace region 6 of the storage tank 1 by a suction pipe 7, where it mixes with stored water 8 at the level of circulating pump 5. As a result, this $CO_2$ gas is dissolved and blended in with the water 8 to produce carbonated water. The circulating pump 5 is driven by an electric motor 9 located directly beneath the pump.

Cooling of the water in the tank 1 takes place by a set of evaporator coils 10 of a cooling system, not shown. The cooling coils 10 are located on the outer surface of a thermally conducting side wall of storage tank 1, and operate to form an ice bank 11 in the interior of storage tank 1 adjacent the coils. The thickness of this ice bank 11 is monitored by an ice sensor 12 which also controls the refrigeration cycle and thus the refrigerating capacity of the system.

The effect of the ice bank 11 is that the supply of water 8 is cooled to a constant temperature in the immediate range of its freezing point without very sensitive detection and evaluation devices. The constant temperature is also maintained when a change in the water level occurs, i.e., when carbonated water is removed by way of the output line 4 and in its place warmer water, controlled by a water level sensor 13, is fed into the tank 1 by the feed pipe 3. In the latter instance, the ice bank 11 tends to melt relatively quickly in certain areas; however, it is again rapidly built up by the cooling effect of evaporator coils 10.

To avoid an uneven formation of the ice bank 11, particularly at low ambient temperatures, a controller which is shown by reference numeral 14, has an output control lead 15 which is connected to and controls the on/off operation of a condenser also not shown, of the cooling system. Additionally, a sensor 12, which detects the thickness of ice bank 11, a sensor 16, which detects the room temperature, and a water level sensor 13 also generate signals which are coupled to controller 14 and feed inputs thereto. The controller 14 is responsive to these signals so as to produce an operational mode which is shown in FIG. 2.

Figure 2:
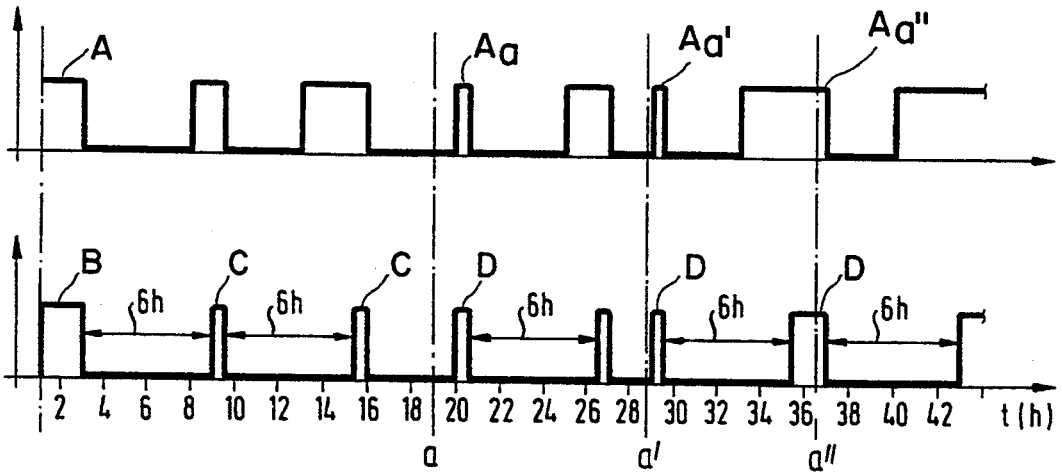
FIG. 2 is a set of time related waveform helpful in understanding the operation of the subject invention.

Referring now to FIG. 2, the upper waveform A represents a typical signal output of the ice sensor 12 with respect to time t(h). The lower waveform illustrates the operation of the cooling system in accordance with the subject invention where, for example, an ambient room temperature of about 8° C. is sensed and where normal room temperature of about 18° C. is encountered.

It can be seen from the lower waveform that following the first turn-on of the equipment and accordingly the cooling system at waveform segment B, the latter is turned ON for two hours, so that the first buildup of an ice bank 11 of a sufficient thickness can take place. Thereafter, even though the ice sensor 12 signals for a turn-on of the cooling system, the cooling system is turned on only for a half hour as a function of sensed ambient temperature, as shown by waveform segment C, every six hours (6h), whereupon the cycle repeats itself. If, on the other hand, carbonated water in the storage tank is removed at any time, such as a, a', a'' for the preparation of a beverage and the corresponding amount of fresh water is later conveyed by supply line 2, the six-hour pause or OFF period is interrupted and the cooling circuit begins immediately to cool as shown by the waveform segment D if a corresponding signal $A_a$, for example, is concurrently being sent from ice bank sensor 12 to the controller 14. This interruption also takes place for the ice sensor signals $A_{a'}$ and $A_{a''}$.

Stated another way, after an initial ice build up following first turn-on of the system and depending on the ambient temperature sensed by the sensor 16, the cooling system will turn on for a predetermined ON period followed by a predetermined OFF period. These ON and OFF periods are variable as a function of ambient temperature as sensed by the sensor 16 and will recycle in absence of any carbonated water removed. If, however, water removal takes place, the OFF period is interrupted and system turn-on will occur the next time a signal from the ice sensor is received and the ON and OFF cycle as determined by the system controller 14, will resume unless it is again interrupted by another water removal signal from the water level sensor 13.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. Apparatus for mixing fresh water with $CO_2$ to produce and store carbonated water, comprising:

a storage tank for cooling and storing carbonated water;

means for feeding fresh water and $CO_2$ into the storage tank;

means for removing carbonated water from the storage tank;

means located inside the storage tank for mixing $CO_2$ gas with fresh water in the storage tank for producing carbonated water;

a water cooling system including a set of cooling coils for forming an ice bank on an inner wall surface of the storage tank;

ice sensor means for generating a first sensor signal indicative of the thickness of the ice bank inside the storage tank;

water level sensor means for generating a second sensor signal indicative of the water level inside the storage tank;

temperature sensor means for generating a third sensor signal indicative of the ambient temperature outside the storage tank; and cooling system controller means coupled to and being responsive to said first, second, and third sensor signals for controlling the operation of the water cooling system to initially form an ice bank of a predetermined thickness and thereafter turn the cooling system on and off in a repetitive cycle of predetermined ON and OFF time periods as a function of the sensed ambient temperature.

2. The apparatus according to claim 1 wherein said cycle is interrupted in response to said second sensor signal generated when water is removed from the tank so as to initiate a new ON time period.

3. The apparatus according to claim 2 wherein the next turn on time period following an interruption of said cycle is coincident with a next said first sensor signal.

* * * * *